US007957885B2

(12) United States Patent
Kernwein et al.

(10) Patent No.: US 7,957,885 B2
(45) Date of Patent: Jun. 7, 2011

(54) METHOD FOR OPERATING A GROUP OF GLOW PLUGS IN A DIESEL ENGINE

(76) Inventors: Markus Kernwein, Bretten-Büchig (DE); Olaf Toedter, Walzbachtal (DE); Andreas Bleil, Ludwigsburg (DE)

( * ) Notice: Subject to any disclaimer, the term of this patent is extended or adjusted under 35 U.S.C. 154(b) by 586 days.

(21) Appl. No.: 11/992,078

(22) PCT Filed: Sep. 21, 2006

(86) PCT No.: PCT/EP2006/009176

§ 371 (c)(1),
(2), (4) Date: Mar. 14, 2008

(87) PCT Pub. No.: WO2007/033825

PCT Pub. Date: Mar. 29, 2007

(65) Prior Publication Data

US 2010/0094523 A1 Apr. 15, 2010

(30) Foreign Application Priority Data

Sep. 21, 2005 (DE) ..... 10 2005 044 854
Mar. 4, 2006 (DE) ..... 10 2006 010 081
Mar. 4, 2006 (DE) ..... 10 2006 010 082
Mar. 4, 2006 (DE) ..... 10 2006 010 083

(51) Int. Cl.
*F02D 45/00* (2006.01)
*F02P 19/02* (2006.01)
*H05B 1/02* (2006.01)

(52) U.S. Cl. ..... 701/102; 123/145 A; 219/483; 219/494

(58) Field of Classification Search ..... 701/102, 701/106, 113, 115; 123/145 A, 145 R, 605, 123/179.21, 179.6; 73/114.62; 219/270, 219/483, 490–492, 497, 544, 494; 361/264–266; 700/300

See application file for complete search history.

(56) References Cited

U.S. PATENT DOCUMENTS 5,144,922 A * 9/1992 Kong ..... 123/145 A
5,206,483 A * 4/1993 Aota ..... 219/270
5,285,640 A * 2/1994 Olivo ..... 60/274
6,148,258 A 11/2000 Boisvert et al.
6,247,300 B1 * 6/2001 Muramatsu et al. ..... 60/39.091
7,632,322 B2 * 12/2009 Edlund ..... 48/197 R (Continued)

FOREIGN PATENT DOCUMENTS

DE 36 08 602 A1 9/1987

(Continued)

OTHER PUBLICATIONS

"Das Elektronisch Gesteuerte Glühsystem Iss für Dieselmotoren" published in DE-Z MTZ Motortechnische Zeitschrift 61, (2000) 10, S.668-675.

*Primary Examiner* — Willis R Wolfe, Jr.
*Assistant Examiner* — Johnny H Hoang

(57) ABSTRACT

Method for controlling a group of glow plugs in a diesel engine, which are connected with a direct current source via individual supply lines and which are to be controlled by a pulse width modulation process at the same temperature, at least in time average. The electric resistance of the glow plugs, less the resistance of the supply line to the heating element of the glow plugs, is determined during operation of the engine and a relative pulse width at which the glow plugs are to be operated is calculated from the value so obtained.

22 Claims, 1 Drawing Sheet

U.S. PATENT DOCUMENTS

| | | | | |
|---|---|---|---|---|
| 2001/0050275 | A1 | 12/2001 | Uhl | |
| 2004/0255889 | A1 | 12/2004 | Kumada et al. | |
| 2005/0081812 | A1 | 4/2005 | Toedter et al. | |
| 2006/0102611 | A1* | 5/2006 | Reissner et al. | 219/270 |
| 2006/0272212 | A1* | 12/2006 | Edlund | 48/197 R |
| 2006/0289425 | A1 | 12/2006 | Serra et al. | |
| 2008/0302777 | A1* | 12/2008 | Ando | 219/270 |
| 2009/0294431 | A1* | 12/2009 | Sakurai | 219/268 |

FOREIGN PATENT DOCUMENTS

| | | | |
|---|---|---|---|
| DE | 39 11 506 | A1 | 10/1990 |
| DE | 197 18 750 | A1 | 11/1997 |
| DE | 37 38 055 | A1 | 5/1999 |
| DE | 199 36 729 | C1 | 11/2000 |
| EP | 0 359 848 | A1 | 9/1988 |
| EP | 0 315 934 | A1 | 11/1988 |

* cited by examiner

METHOD FOR OPERATING A GROUP OF GLOW PLUGS IN A DIESEL ENGINE

The present invention relates to a method for controlling a group of glow plugs in a diesel engine. A method of this kind has been known from the paper entitled "The electronically controlled glow system for diesel engines", published in DE-Z MTZ Motortechnische Zeitschrift 61, (2000) 10, pp. 668-675.

SUMMARY OF THE INVENTION

Now, it is the object of the present invention to show how the ignition behavior of a diesel engine, and the service life of the glow plugs used in it, can be improved.

The invention achieves this objective by determining a value corresponding to an electric resistance of the glow plugs, less a resistance of a supply line to a heating element of the glow plugs, during operation of the engine and calculating a relative pulse width at which the glow plugs are to be operated from the value.

DETAILED DESCRIPTION

Figure 1:
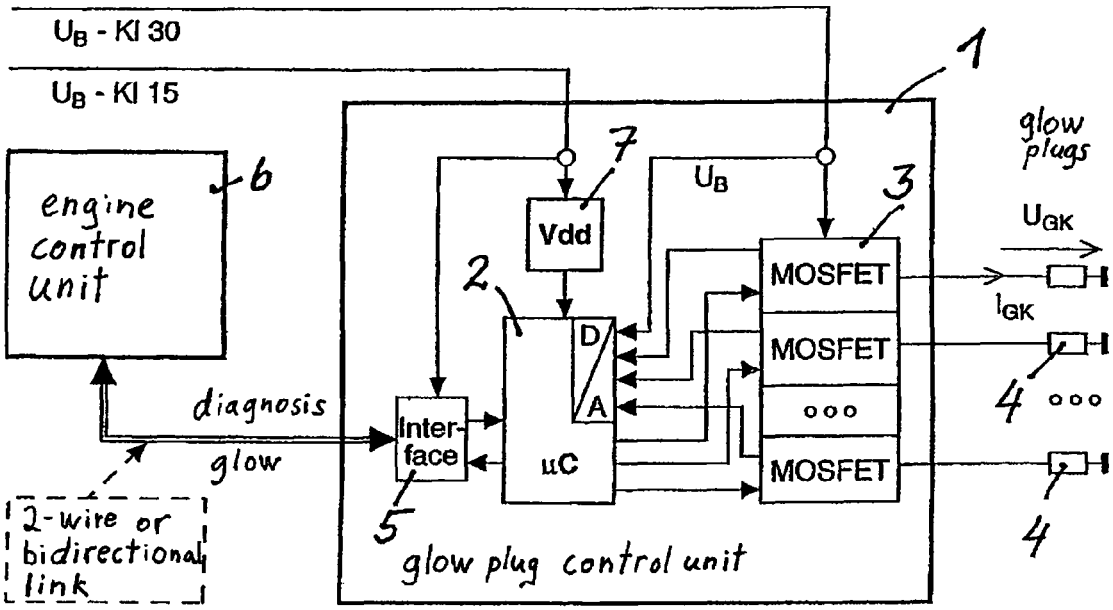
FIG. 1 shows a block diagram of the present invention.

FIG. 1 shows a block diagram of a glow plug control unit 1 intended for carrying out the known method. That control unit comprises a microprocessor 2 with an integrated digital-to-analog converter, a number of MOSFET power semiconductors 3 for switching on and off an identical number of glow plugs 4, an electric interface 5 for establishing connection with an engine control unit 6 and an internal voltage supply 7 for the microprocessor 2 and the interface 5. The internal power supply 7 is connected with the vehicle battery via "terminal 15" of the vehicle.

The microprocessor 2 controls the power semiconductors 3, reads their status information and communicates with the engine control unit 6 via the electric interface 5.

The signals required for communication between the engine control unit 6 and the microprocessor 2 are conditioned by the interface 5. The voltage supply 7 supplies a steady voltage for the microprocessor 2 and the interface 5.

A glow plug should maintain a constant temperature (nominal temperature or steady-state temperature), typically in the range of 1000° C., at least when the engine has reached its operating temperature. For maintaining the steady-state temperature, modern glow plugs do not require the full voltage provided by the electric system of the vehicle, but rather a voltage of typically 5 Volts to 6 Volts. The power semiconductors 3 are controlled for this purpose by the microprocessor 2 by a pulse-width modulation method with the result that the voltage provided by the vehicle system, which is supplied to the power semiconductor 3 via "terminal 30" of the vehicle, is modulated so that the desired voltage is applied to the glow plugs in time average. Any variation of the voltage of the on-board system can be corrected by changing the ON-time during pulse-width modulation.

The glow plugs in the engine cylinders are cooled to a different extent depending on the engine speed and the engine load or the engine torque. In order to still keep the glow plug temperature constant with the engine at operating temperature, the electric power applied to the glow plugs is adjusted to the varying conditions. This is done, according to signals received from the engine control unit 6, by increasing or lowering the target value of the voltage applied to the glow plugs 4 in time average, which is the same for all glow plugs.

When a group of glow plugs is supplied from one and the same direct current source, and is controlled at the same pulse width, the glow plugs will nevertheless not heat up to the desired temperature and to the same temperature; instead, the temperatures reached by the different glow plugs will vary. Glow plugs that heat up excessively have a reduced service life. Glow plugs that do not reach their predefined specified target temperature lead to deterioration of the ignition behavior of the engine. Undesirable reduction of the service life can be avoided by setting the control of the glow plugs to a low mean target temperature. However, this provides the disadvantage that glow plugs which normally would be operable at a higher temperature will be operated at a lower temperature as a precautionary measure so that part of their efficiency will remain unused. In addition, there remains the disadvantage that any variation of the temperatures reached by the glow plugs is undesirable with respect to the ignition behavior of the engine.

According to the invention defined in Claim 1, a group of glow plugs in a diesel engine, being preferably equal one to the other—except for production tolerances—and being connected with a direct current source via individual supply lines, are controlled by a pulse width modulation process in order to operate the glow plugs at the same temperature, at least in time average. For this purpose the electric resistance of the glow plugs without the resistance of the supply line to the heating element of the glow plugs is determined during operation of the engine. Using the value so obtained a relative pulse width at which the glow plugs are to be operated is calculated.

The glow plugs can be controlled uniformly and all together as one group. This is useful especially if a mean value can be defined for the resistance of the supply lines leading to the heating elements from which the resistance of the individual supply lines differs by an amount so small that adequate approximation to the true value of the resistance of the heating elements, which allows heating-up of the heating elements to be precisely controlled, can still be achieved by simply using the mean value of the resistance of the supply lines.

There is also the possibility to uniformly control glow plug sub-groups of an engine. Preferably, however, the glow plugs should be controlled separately and individually because in that case the influence of the resistance of the different supply lines, and also the influence of the resistance of the different current paths in the control unit, can be accounted for individually in the control unit.

It is an advantage of the invention that, apart from the resistance of the glow plug, additional parameters suited for influencing the temperature of the different glow plugs can be used as input parameters in controlling the glow plugs by pulse width modulation and, accordingly, in controlling the individual glow plugs. One such additional parameter, which can be used with particular advantage as input parameter for the control by pulse width modulation, is the electric resistance of the heating element of the glow plugs which shows production-related variation. Preferably, the electric resistance of the heating element of each glow plug is determined in operation of the engine and from that value an individual relative pulse width is derived which is then used to control each glow plug of the engine individually.

This provides significant advantages:

Production-related tolerances in the electric resistance of the glow plugs that lead to corresponding variation of the glow plug temperatures can be balanced out.

Due to the reduced variation of the glow plug temperatures, the control can be designed for a higher steady-state temperature. This has the effect to improve the ignition behavior of the diesel engine, especially in its cold-running phase.

As variations of the glow plug temperatures are considerably reduced by application of the invention, the service life of the glow plugs can be extended. The individual resistance of the glow plugs being accounted for, even glow plugs the resistance of which differs extremely from the nominal resistance will not get hotter than plugs that exhibit the nominal resistance.

As service life progresses, the electric resistance of glow plugs in most of the cases will change and, under prior art conditions, will lead to a lower glow plug temperature which in turn will result in deteriorated ignition behavior and starting behavior. According to the invention, however, the influence of such variation on the heating temperature reached will be balanced out in that the resistance of the individual glow plugs is measured and the individual variation in resistance will be accounted for in the pulse width modulation process. The variation in resistance of the glow plug is used as an input parameter for control of the glow plug by pulse width modulation, in order to extend the relative pulse width in accordance with the changed glow plug resistance and to thereby balance out the change in resistance so that it will not result in a reduction of the glow plug temperature.

According to the solution of the invention defined in Claim 5, a group of glow plugs in a diesel engine, preferably—except for production tolerances—equal one to the other, and connected with a direct current source via individual supply lines, are controlled by a pulse width modulation process in order to operate the glow plugs at the same temperature, at least in time average. For this purpose the electric resistance of each glow plug is determined. Using the values so determined an individual pulse width is calculated for the separate control of each individual glow plug.

Just as the solution defined in Claim 1, the solution defined in Claim 5 has the result that the effective resistance of the heating elements of the glow plugs is taken into account much more efficiently so that the advantages achieved are the same:

Production-related tolerances in the electric resistance of the glow plugs that lead to corresponding variation of the glow plug temperatures can be balanced out.

Due to the reduced variation of the glow plug temperatures, the control can be designed for a higher steady-state temperature. This has the effect to improve the ignition behavior of the diesel engine, especially in its cold-running phase.

As variations of the glow plug temperatures are considerably reduced by application of the invention, the service life of the glow plugs can be extended. The individual resistance of the glow plugs being accounted for, even glow plugs the resistance of which differs extremely from the nominal resistance will not get hotter than plugs that exhibit the nominal resistance.

As service life progresses, the electric resistance of glow plugs in most of the cases will change and, under prior art conditions, will lead to a lower glow plug temperature which in turn will result in deteriorated ignition behavior and starting behavior. According to the invention, however, the influence of such variation on the heating temperature reached will be balanced out in that the resistance of the individual glow plugs is measured and the individual variation in resistance will be accounted for in the pulse width modulation process. The variation in resistance of the glow plug is used as an input parameter for control of the glow plug by pulse width modulation, in order to extend the relative pulse width in accordance with the changed glow plug resistance and to thereby balance out the change in resistance so that it will not have the result to reduce the glow plug temperature.

According to the solution of the invention defined in Claim 10, a group of glow plugs in a diesel engine, being preferably equal one to the other—except for production tolerances—and being connected with a direct current source via individual supply lines, are controlled by a pulse width modulation process in order to operate the glow plugs at the same temperature, at least in time average. The pulse width modulation process determines the energy that is to be supplied to the glow plugs per period. Due to the given heat capacity of the glow plugs and especially of their heating elements, and due to the given thermal conductivity of the glow plug components, which can be assumed to be approximately the same for all glow plugs of the same type, supplying predetermined energy amounts per period advantageously results in a predefined temperature rise in the heating elements of the glow plugs.

Supplying predefined energy amounts indirectly means that the resistance of the glow plugs and of their supply lines is taken into account, which is the subject of the solutions described in Claims 1 and 10.

The length of a period, during pulsed control of the glow plugs, typically is between 10 ms and 100 ms, preferably between 30 ms and 35 ms. By presetting a voltage and a pulse width, during which the voltage is applied to the glow plug, it is possible to supply the glow plug with a defined amount of electric energy during such a period. By measuring the current, voltage and possibly further parameters, it is possible to determine the energy actually applied during the period and to balance out any energy deficit or energy surplus in one of the next periods. Preferably, this is done by calculating the deficit or surplus of energy applied in one period during the next period, and balancing it out during the period following thereafter. The process can be started in a first period by presetting a voltage and a relative pulse width typical for the particular glow plug type used.

A measure of the energy supplied to the glow plugs is defined by the product of the square of the voltage applied to the glow plug multiplied by the period of time during which the voltage is applied. There are, however, a number of parameters that influence the energy which finally is supplied to the heating elements of the glow plugs and that influence the operating temperature. Preferably, therefore initially an amount of energy is preset which is to be supplied to the heating elements of the glow plugs in each period, and an initial pulse width determined, during which the voltage is applied to the glow plugs during the period of interest. The initial pulse width is based on the technical data of the glow plugs and a given voltage of the direct voltage source. The pulse width is then adjusted giving regard to one or more parameters that influence the operating temperature of the heating elements of the glow plugs. This provides the advantage that variation of the operating temperatures of the glow plugs installed at the same engine is clearly reduced.

Conveniently, the relative pulse width is changed by varying the absolute pulse width while leaving the period unchanged. The term period is used in this case to describe the sum of one ON time and of the next following OFF time of a glow plug. There would, however, also be the possibility to change the relative pulse width by keeping the absolute pulse width constant and varying the OFF time and/or the entire length of a period instead.

In order to ensure that the direct current source will not be loaded unnecessarily by the glow plugs, the glow plugs are operated in time succession, if possible, which means that the ON times of the glow plugs are organized so as to follow each other. When the sum of the pulse widths of the group of glow plugs exceeds the length of a period, the excessive pulse width is transferred to the next following period in which it will overlap the ON times of the glow plugs starting again in that period.

The method can be carried out uniformly for the group of glow plugs. Any differences between the individual glow plugs have the result that the operating temperatures reached by the heating elements of the glow plugs of an engine at operating temperature of the engine vary instead of being identical, are disregarded in that case. In order to reduce operating temperature variations of the heating elements of the glow plugs, the method according to the invention preferably is carried out for each glow plug separately, and the pulse width for application of a predefined energy amount to the glow plugs is determined for each glow plug separately.

Parameters that influence the operating temperature of the heating elements of the glow plugs include the electric resistance of the glow plugs and, especially of its heating element. The values of the electric resistance may vary significantly. According to an advantageous further development of the invention, the resistance of the glow plug and/or the resistance of its heating element is therefore determined separately for each glow plug, and an individual relative pulse width is calculated from that value for separate operation of each glow plug.

This again provides the following advantages:

- Production-related tolerances in the electric resistance of the glow plugs that lead to corresponding variation of the glow plug temperatures can be balanced out.
- Due to the reduced variation of the glow plug temperatures, the control can be designed for a higher steady-state temperature. This has the effect to improve the ignition behavior of the diesel engine, especially in its cold-running phase.
- As variations of the glow plug temperatures are considerably reduced by application of the invention, the service life of the glow plugs can be extended. The individual resistance of the glow plugs being accounted for, even glow plugs the resistance of which differs extremely from the nominal resistance will not get hotter than plugs that exhibit the nominal resistance.
- As service life progresses, the electric resistance of glow plugs in most of the cases will change and, under prior art conditions, will lead to a lower glow plug temperature which in turn will result in deteriorated ignition behavior and starting behavior. According to the invention, however, the influence of such variation on the heating temperature reached will be balanced out in that the resistance of the individual glow plugs is measured and the individual variation in resistance will be accounted for in the pulse width modulation process. The variation in resistance of the glow plug is used as input parameter for control of the glow plug by pulse width modulation, in order to extend the relative pulse width in accordance with the changed glow plug resistance and to thereby balance out the change in resistance so that it will not have the result to reduce the glow plug temperature.

The following applies to all the three solutions to the object of the invention:

The term relative pulse width as used herein is meant to describe the pulse width related to the length of the modulation period. Preferably, the period is constant and only the pulse width is varied. However, there is also the possibility to keep the pulse width constant and to vary the period instead.

Another advantage of the invention is seen in the fact that apart from the resistance of the glow plug other parameters that influence the temperature of the individual glow plugs may likewise be used as input parameters for operation of the glow plugs by pulse width modulation and, thus, for operation of the individual glow plugs. One such further parameter, which can be used with advantage as input parameter for the control by pulse width modulation, is the voltage of the direct current source that supplies the glow plugs, especially the voltage of the battery of a vehicle equipped with a diesel engine. That voltage may vary in response to the current load, the temperature and the age of the battery. Such variation may occur as a function of time and may be different for the glow plugs of an engine.

Another parameter which may be used advantageously as an input parameter for the operation by pulse width modulation is the resistance of the supply line that leads from the control unit of the glow plugs to the respective glow plug and to its heating element, respectively. The mere fact that the supply lines are different in length already leads to different supply line resistances. Contact resistances, especially of electric plug-in connectors, encountered in the supply line, have to be added. Appropriately, the resistance of the supply line in the respective glow plug, ending at the heating element as such, is likewise added to the supply line resistance.

The resistance of a supply line from the glow plug control unit to the heating element of the glow plug typically is in the range of 10 mΩ to 20 mΩ. Compared with that, the resistance of the heating element of the glow plug typically is between 400 mΩ and 500 mΩ at room temperature. The resistance of the supply line to the heating element of the respective glow plug is preferably regarded as being constant, neglecting production-related tolerances, and is assumed to be equal to a nominal value which is specified as a typical value for each type series of diesel engines by its design specifications. This allows an advantageous further development of the method wherein the current flowing through the respective glow plug is measured; therewith the voltage drop caused by the supply line is calculated taking the known nominal value of the supply line resistance into account. Using the value so obtained the actual voltage drop at the glow plug is calculated taking the known or currently measured voltage of the direct current source into account. The result is then used as an input parameter for the pulse width modulation control. This permits the effective voltage, which drops at the heating element of the glow plug, to be optimized irrespective of the particular supply line resistance, and to be adjusted so precisely that the different resistance values of the individual supply lines will no longer, or not notably, influence the effective voltage dropping at the heating element.

Any high current losses occurring in the glow plug control unit, that may be different for the current paths in the glow plug control unit assigned to the individual glow plugs, can be balanced out correspondingly. Typically, the control unit comprises, as a gate for current to each glow plug, a switchable power semiconductor, especially a MOSFET, which is switched on and off by a calculator circuit, especially a microprocessor or a microcontroller. Advantageously, the resistance of the current paths in the control unit provided for the different glow plugs may be selected as an additional parameter that influences the glow plug temperature and may be used as input parameter for pulse width modulation control of the voltage applied to the glow plugs in time average. In this case, similar to the case where the supply line resistance on the way from the glow plug control unit to the heating element of the respective glow plug is taken into consideration, the nominal value predefined by the respective design specifications is taken as resistance of the respective current path in the control unit for each type series of glow plug control units, neglecting any production-related tolerances. That nominal value typically is of the same order as the nominal value of the resistances of the supply lines from the control unit to the glow plugs. In the case where the losses over the current paths in the control unit are taken into account, the current flowing through the respective glow plug is likewise measured, using the value so measured the voltage drop caused by the current path is calculated taking the known nominal value of the resistance on the respective current path into account, preferably the known nominal value of the resistance of the associated supply line from the control unit to the heating element of the glow plug is also taken into account. Then the result so calculated is used to derive voltage actually dropping at the glow plug or at its heating element, respectively, taking the known or measured voltage of the direct current source into account. The value so obtained is used as an input parameter for the pulse width modulation control. In this way, it is also possible to balance out the influence of the high current losses in the control unit on the variation of the glow plug temperatures.

One parameter that can be used with advantage as input parameter for control of the effective voltage drop at the glow plug or its heating element, respectively, by the pulse width modulation method is the voltage of the direct current source supplying the glow plug, especially the voltage of the battery of a vehicle equipped with a diesel engine. That voltage may vary in response to the respective charge, temperature and the battery age. It may be dependent on time and be different for the glow plugs of an engine.

It is an advantage of the invention that it allows the presence of different glow plug types to be detected and especially that it permits to distinguish between glow plugs with a metallic glow rod and glow plugs with a ceramic glow rod. Different glow plug types may differ by different electric resistances and/or by different heat capacities. Different resistances can be determined by measuring the current and voltage, while different heat capacities can be detected through different heating-up speeds for the same output. The feature that different glow plug types can be detected provides two significant advantages: On the one hand, it provides the possibility, in case of need, to simultaneously use different glow plugs in one and the same engine, as the glow plug control unit is capable of bringing even different glow plugs to the same steady-state temperature. On the other hand, by storing certain parameters, for example the electric resistance at a selected temperature of, for example, 20° Celsius, and/or the characteristics of different glow plug types, the control unit can be enabled to adapt itself automatically to the particular glow plug types installed. A characteristic well suited for that case is the response of the electric resistance to temperature.

A further parameter that can be selected according to the invention is the temperature of the glow plugs which can be used as input parameter for controlling the voltage, that is applied to the glow plugs in time average, by pulse width modulation, especially for the purpose of adjusting the temperature of the respective glow plug to a nominal value. When the resistance of the heating element is known, then the current temperature of the heating element can be derived from the known temperature dependence of the resistance of the heating element, and can then be used as actual value in a temperature controller in the glow plug control unit for adjusting that value to a nominal value preset by the control unit.

A further parameter that can be taken into consideration in the pulse width modulation process is the age-induced deterioration of the respective glow plug. In most of the cases, the resistance of a glow plug changes as its service life progresses so that the operating temperature of older glow plugs, being controlled in the conventional way, will decrease with progressing age. This can be counteracted according to the invention by taking the age-induced deterioration of each glow plug into account. For this purpose, the number of revolutions the diesel engine has performed since the date of installation of the glow plug may be taken as a measure for the age-induced deterioration. That number may be supplied to the glow plug control unit by an engine control unit of the diesel engine, or may be derived directly in the glow plug control unit from a speed signal supplied by a revolution counter.

Alternatively, the sum of the electric energy injected may also be taken as a measure for the deterioration of the glow plug. That possibility is preferred over the one where the number of revolutions of the diesel engine is used as a measure for the deterioration through ageing, because it can be implemented in the glow plug control unit without any necessity to supply the latter with an input signal from a revolution counter or an engine control unit. Preferably, the product of the square of the voltage drop at the heating element of the glow plug multiplied by the time during which it was applied to the glow plug is taken as a measure for the energy supplied to the glow plug. That product is determined for all or for selected periods of the pulse width modulation process, and is summed up in a counter, for example. However, it is not necessary to determine the product of the square of the voltage multiplied by the duration it was applied for all of the periods, and to sum up the values so obtained thereafter. That process may be restricted, for example, to every hundredth or thousandth period. Preferably, however, all periods should be taken into account because that leads to more reliable information on the ageing effect without any additional expense as it is possible to implement the process by suitable software in the glow plug control unit for which purpose the software defining the individual process steps would be stored in the memory of a microprocessor or a microcontroller.

As ageing proceeds only slowly, it is not recommended that the ageing effect be updated and input to the pulse width control in each period of the pulse width modulation process. Instead, it is preferred to adjust for the ageing effect for purposes of the pulse width control only in steps, for example by predefining counting steps in a counter provided for summing up the energy supplied to the glow plug, and by adapting the pulse width to the progressing deterioration through ageing every time a counting step is reached. The counting steps may be spaced equally one from the other. If ageing develops non-linearly with respect to the sum of energy supplied it will then be of advantage to weigh the energy amounts to be summed up between two counting steps according to the non-linear dependency of the ageing effect on the increasing energy sum, and to then count the amounts so weighed. Alternatively, there is also the possibility to arrange the counting steps at non-uniform spacing, i.e. so that approximately the same amount of deterioration, leading to a corresponding adjustment of the pulse width in the pulse width modulation process according to the invention, will occur between one step and the next, giving due regard to the nonlinear relationship between the sum of energy applied and the deterioration of the glow plug.

The deterioration of the glow plugs can be taken into account in the control of the pulse width by using one characteristic line, or a field of characteristic lines, defining the electric resistance of the heating element of a typical glow plug that occurs at one or more defined temperatures in response to the progressing deterioration. Based on the current resistance of the respective glow plug derived at any time from the respective characteristic, the invention then determines the effective voltage to occur at the heating element of the glow plug when a given energy amount is to be supplied to the glow plugs per period, for which the square of the product of the voltage applied to the heating element multiplied by the relative pulse width is taken as a measure.

The invention makes it possible to make ongoing corrections to the relative pulse width based on current measurements. In addition, the invention makes it possible to predict any variation of the pulse width used for operation of different glow plugs, that may become necessary in the future, by forming a model of the progressive variation of the parameter that influences the temperature of the glow plug resulting from the pulse width modulation. Based on that model, it is then possible to predict the value of the parameter for the near future from one or more values of the respective parameter determined in the past, and to use the predicted value of that parameter as an input parameter for pulse width modulation control of the voltage applied to the respective glow plugs in time average. While, preferably, that model is built up from empirical values obtained in respect of the development of the parameter of interest, it may also be derived from theoretical considerations regarding the behavior of a glow plug.

Especially well suited for such a prognosis is the development of the resistance of the heating element of the glow plug so that, preferably, a model is formed for that development. Preferably, the model defines the variation of the resistance of the glow plug for one or more selected temperatures as a function of the age-induced deterioration of the glow plug, and may be stored in the glow plug control unit in the form of a characteristic or a field of characteristics. As has been mentioned before, the measure for the deterioration may be selected to be the sum of the number of revolutions of the diesel engine encountered since the installation of the glow plug, for example, or the sum of the electric energy supplied to the glow plug.

The method according to the invention is particularly well suited for energy-controlled heating of the glow plugs. In that case, the pulse width modulation process is used to define the electric energy to be supplied to a single glow plug in each period. According to the invention that energy value, which is to be supplied to each glow plug per period, is adjusted by taking one or more parameters into account that are of importance for the glow plug temperature obtained so that the variation of the temperatures of glow plugs belonging to one engine is clearly reduced.

The invention makes it possible to minimize variations of the glow plug temperatures by balancing out certain parameters that influence the glow plug temperatures. Accordingly, the glow plugs can be controlled more precisely than in the prior art. This permits both the service life of the glow plugs, and the nominal temperature that is to be reached by the glow plugs in continuous operation, to be increased. For monitoring the condition of the glow plugs the resistance of the heating elements of the glow plugs can be determined more precisely from current and voltage if supply line losses and internal losses occurring in the glow plug control unit are taken into account. Such losses can be approximated by a general value from the constructional design of the glow plug control unit and the supply lines. Empirical values from former periods of the pulse width modulation process can be used in later periods for optimizing the relative pulse width. The influence of the particular deterioration of individual glow plugs can be balanced out. Future variations of the resistance of heating elements can be compensated in advance based on a model and/or through observation of the age-dependent variation of the resistance of the heating element. As the temperatures of the individual glow plugs are recorded separately, and are taken into account in defining the relative pulse width, it is even possible to record and balance out influences on the glow plug temperature resulting from different installation conditions and/or combustion processes and/or charge changes in different cylinders of the diesel engine.

The invention provides special advantages when an engine is started in the cold-running phase because it permits higher glow plug temperatures to be reached without any risk and because the age-related variation of the resistance of an older glow plug can be balanced out by individual extension of the relative pulse width for the respective glow plug.

What is claimed is:

1. Method for controlling a group of glow plugs in a diesel engine, each glow plug being connected with a direct current source via an individual supply line and controlled by a pulse width modulation process the same temperature, at least in time average, the method comprising:

determining a value corresponding to an electric resistance of the glow plugs, less a resistance of a supply line to a heating element of the glow plugs, during operation of the engine; and calculating a relative pulse width at which the glow plugs are to be operated from the value.

2. Method according to claim 1, wherein a resistance of the supply line to the heating element of the glow plugs is assumed to be a nominal value defined as the typical value of a constructional design of the diesel engine neglecting production-related tolerances, and a current flowing through the glow plugs is measured, therewith a voltage drop caused by the supply line is calculated using the nominal value of the supply line resistance, and an actual voltage drop at the glow plug is calculated from the value so obtained using a known or measured voltage of the direct current source, and therewith an input parameter is calculated for control of the voltage dropping at the heating elements in time average by pulse width modulation.

3. Method according to claim 1, wherein a control unit is used in which a switchable power semiconductor is used to switch a current to the glow plugs on and off, and wherein the resistance of the current paths provided in the control unit for the glow plugs is selected as a parameter that influences an operating temperature of the glow plugs, and is used as input parameter for the control by pulse width modulation.

4. Method according to claim 3, wherein the resistance of the current path assigned to the glow plugs in the glow plug control unit is assumed to be a nominal value predefined for each type series of glow plug control units by the constructional design of the diesel engine neglecting production-related tolerances, and wherein the current flowing through the glow plugs is measured, therewith the voltage drop caused by the current path is calculated using the known nominal value of the resistance of the current path, and therewith the actual voltage drop at the heating element of the glow plug is calculated using a known or measured voltage of the direct current source, and therewith an input parameter is calculated for control of the voltage dropping at the heating elements in time average by pulse width modulation.

5. Method for controlling a group of glow plugs in a diesel engine, each glow plug being connected with a direct current source via an individual supply line and operated by a pulse width modulation process at a same temperature, at least in time average, the method comprising:

determining a resistance of a heating element of each glow plug during operation of the engine;

calculating an individual relative pulse width, for individually controlling each glow plug, from the determined resistance; and using a switchable power semiconductor control unit to switch the current to the glow plugs on and off and wherein the resistance of the current paths provided in the control unit for the individual glow plugs is used as a parameter for influencing the operating temperature of the glow plugs, and as an input parameter for the control by pulse width modulation.

6. Method according to claim 5, wherein the relative pulse width is calculated taking into account one or more further parameters that influence an operating temperature of the glow plugs.

7. Method according to claim 6, wherein the voltage of the direct current source is selected as the further parameter influencing the operating temperature of the glow plug and is used as an input parameter for the control by pulse width modulation.

8. Method according to claim 6, wherein the resistance of the supply line to the heating element of the respective glow plug is selected as the further parameter influencing its operating temperature and is used as an input parameter for the control by pulse width modulation.

9. Method for controlling a group of glow plugs in a diesel engine, each glow plug being connected to a direct current source via an individual supply line and controlled by a pulse width modulation process at a same temperature, at least in time average, the method comprising:

determining periodic electric energy to be injected into the glow plugs by the pulse width modulation process;

determining an operating temperature of each glow plug by measuring a current flowing through each glow plug taking into account a known or determined voltage drop at a heating element of each glow plug and a known temperature departure of heating element resistance.

10. Method according to claim 9, wherein a predefined energy value, that is to be injected into the glow plugs in each period, is determined by the pulse width during which a voltage of the direct current source is applied to the glow plugs in the respective period, and that the pulse width is adjusted by taking one or more parameters that influence an operating temperature of the glow plugs into account.

11. Method according to claim 9, wherein a defined amount of electric energy is supplied to the glow plug in each period of the pulse width modulation process, by predefining a voltage and a relative pulse width during which the voltage is applied to the glow plug, and wherein the energy actually injected is determined during the same period by measuring a current, voltage and possibly further parameters, and wherein a deficit or surplus of the energy applied in a respective period, compared with a predefined energy to be applied to the glow plugs, is balanced out in a subsequent period.

12. Method according to claim 9, wherein the pulse width for injection of a predefined amount of energy into the glow plugs is determined separately for each glow plug.

13. Method according to claim 12, wherein one or more further parameters that influence the operating temperature of the glow plug are taken into account when the relative pulse width is calculated.

14. Method according to claim 12, wherein the voltage of the direct current source is selected as a parameter influencing the operating temperature of the glow plug and is used as an input parameter for the control by pulse width modulation.

15. Method according to claim 9, wherein the glow plug type is selected as a parameter influencing its operating temperature and is used as input parameter for control by pulse width modulation of the voltage dropping at the heating elements in time average.

16. Method according to claim 9, wherein the temperature of the glow plug is selected as a parameter influencing its operating temperature and is used as input parameter for control by pulse width modulation of the voltage dropping at the heating elements in time average.

17. Method according to claim 9, wherein the deterioration of the respective glow plug is selected as a parameter influencing the operating temperature of the glow plug, and is used as input parameter for the control by pulse width modulation.

18. Method according to claim 17, wherein the sum of the electric energy supplied to a glow plug is selected as measure for the deterioration of the glow plug.

19. Method according to claim 18, wherein the product of the square of the voltage drop at the heating element of the glow plug multiplied by the duration during which it was applied to the glow plug, is selected as measure for the energy supplied to a glow plug, and is determined and summed up for selected periods of the pulse width modulation process.

20. Method according to claim 17, wherein the deterioration of the glow plug is considered as input parameter for the control by pulse width modulation only in steps.

21. Method according to claim 9, wherein the pulse widths of the individual glow plugs are arranged to follow each other in time in each period.

22. Method according to claim 21, wherein the sum of the pulse widths for the group of glow plugs is greater than the width of the selected period, the excessive pulse width is transferred to the next following period in which it overlaps in time the series of pulse widths of the group of glow plugs that starts anew in that period.

* * * * *